US010220293B2

(12) United States Patent
Noorlun

(10) Patent No.: US 10,220,293 B2
(45) Date of Patent: Mar. 5, 2019

(54) SKATEBOARD SAFETY BRAKE

(71) Applicant: Lyle Jerome Noorlun, Huntington Beach, CA (US)

(72) Inventor: Lyle Jerome Noorlun, Huntington Beach, CA (US)

(73) Assignee: Lyle J. Noorlun, Fairmont, NE (US)

( * ) Notice: Subject to any disclaimer, the term of this patent is extended or adjusted under 35 U.S.C. 154(b) by 0 days.

(21) Appl. No.: 15/441,825

(22) Filed: Feb. 24, 2017

(65) Prior Publication Data

US 2018/0243639 A1 Aug. 30, 2018

Related U.S. Application Data

(60) Provisional application No. 62/389,752, filed on Mar. 9, 2016.

(51) Int. Cl.
*A63C 17/14* (2006.01)
*A63C 17/01* (2006.01)

(52) U.S. Cl.
CPC ..... *A63C 17/1436* (2013.01); *A63C 17/017* (2013.01)

(58) Field of Classification Search
CPC ... A63C 17/1436; A63C 17/017; A63C 17/14; A63C 17/1409; A63C 17/1418; A63C 17/1427; A63C 17/1445; A63C 17/1454; A63C 2017/1463; A63C 2017/1472; A63C 2017/1481; A63C 2017/149; A63C 17/16
USPC ..... D21/776; 280/87.041, 87.042, 87.043; 188/5
See application file for complete search history.

(56) References Cited

U.S. PATENT DOCUMENTS 3,622,172 A * 11/1971 Goodwin ..... A63C 5/035 280/11.208
4,040,639 A * 8/1977 Scardenzan ..... A63C 17/01 280/87.042
4,168,076 A * 9/1979 Johnson ..... A63C 17/01 188/5
4,230,330 A * 10/1980 Muhammad ..... A63C 17/01 280/87.042
5,132,883 A * 7/1992 La Lumandier ..... A63C 17/26 280/87.042
5,280,931 A * 1/1994 Horton ..... A63C 17/1436 188/5
D358,626 S * 5/1995 Moldenhauer ..... D21/776
5,716,074 A * 2/1998 Theodorou ..... A63C 17/04 280/11.27
D412,351 S * 7/1999 Gambs ..... D21/765
6,206,389 B1 * 3/2001 Yagi ..... A63C 17/0033 280/87.042
8,522,928 B2 * 9/2013 Orcutt ..... B60T 1/14 188/5
9,067,125 B2 * 6/2015 Colon ..... A63C 17/01
2007/0278758 A1 * 12/2007 Kwak ..... A63C 17/0033 280/87.042

* cited by examiner

*Primary Examiner* — William V Gilbert

(57) ABSTRACT

The present invention is related to a skateboard safety brake that is pear shaped and is coupled to the rear tail portion of a skateboard.

4 Claims, 2 Drawing Sheets

SKATEBOARD SAFETY BRAKE

CROSS-REFERENCES TO RELATED APPLICATIONS

The present application claims the benefit of U.S. provisional application Ser. No. 62/389,752 filed Mar. 9, 2016, which is assigned to the same assignee as the present application and is incorporated by reference herein in its entirety for all purposes.

FIELD OF THE INVENTION

The present invention is related to braking devices for skateboards.

BACKGROUND OF THE INVENTION

The invention relates to skateboard safety, specifically to the braking of skateboards. In the U.S. there are 11 million skateboarders, with an average of 2 skateboards each. Of these skateboarders, there are an average of 64,500 emergency room visits related to skateboards per year. Therefore, there exists a need to improve the safety of skateboards. One way to improve skateboard safety is to improve the ability to slow down and/or stop. Current techniques include the rider jumping off the skateboard, which is dangerous, or using a wheel engaging brake that has insufficient stopping power.

BRIEF SUMMARY OF THE INVENTION

The present invention is related to a skateboard safety brake that is pear shaped and is coupled to the rear tail portion of a skateboard.

BRIEF DESCRIPTION OF THE DRAWINGS

Further details, aspects, and embodiments of the invention will be described by way of example only and with reference to the drawings. Elements in the figures are illustrated for simplicity and clarity and have not necessarily been drawn to scale.

DETAILED DESCRIPTION OF THE INVENTION

Figure 1:
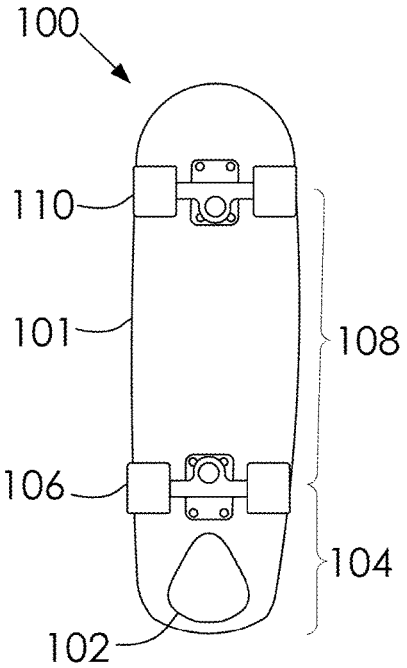
FIG. 1. shows an underside of a skateboard with a brake according to embodiments of the technology.
Figure 2:
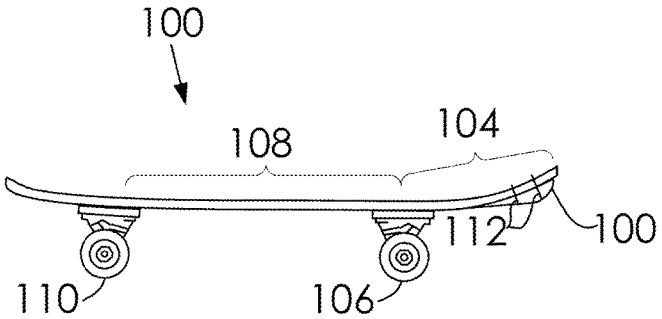
FIG. 2 shows a side view of the skateboard of FIG. 1.

FIGS. 1 and 2 show an embodiment of a skateboard 100 including a brake 102. As shown skateboard 100 includes a deck 101 with a rear tail portion 104 extending from the rear truck wheel assembly 106. The rear tail portion 104 may extend at an angle relative to the middle portion 108 of the deck 101 between the rear truck wheel assembly 106 and the front truck wheel assembly 110. In embodiments, for example as shown in FIGS. 1 and 2, the brake 102 is coupled to the underside of the rear tail portion 104. In embodiments, the brake 102 may be coupled with glue, and/or may be coupled with mechanical fasteners, for example bolts 112 extending through the rear tail portion 104 and the brake 102.

Figure 3:
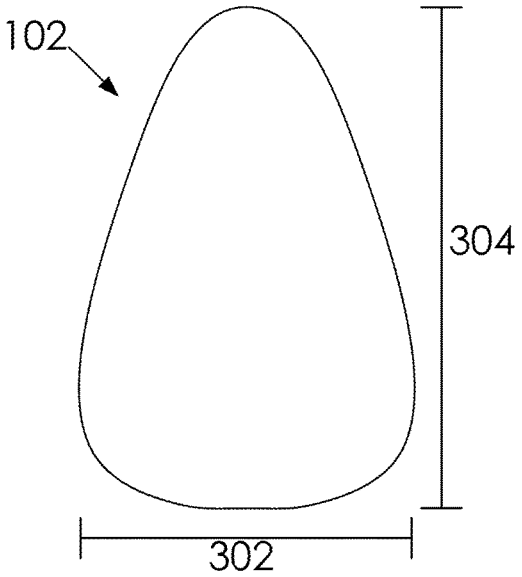
FIG. 3 shows an underside view of a brake according to embodiments of the technology.

FIG. 3 shows an underside view of an embodiment of a brake 102. In embodiments, the brake 102 may be 3 inches in the width direction 302 and 4 inches in the length direction 304, however other dimensions are envisioned. As shown, the brake 102 is shaped like a pear with a widest portion toward the rear end of the brake that tapers toward the front end of the brake. The pear shape of the brake 102 prevents the brake from interfering with skateboard tricks performed by a rider of the skateboard and from interfering with the rear truck wheel assembly 106.

Figure 4:
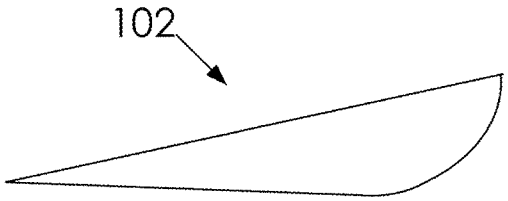
FIG. 4 shows a side view of the brake of FIG. 3.

FIG. 4 shows a side view of the brake 102. As shown, the brake 102 has a thicker rear portion that decreases from the rear end of the brake toward the front end of the brake. In embodiments, the brake 102 may have a maximum thickness of 1 inch and may taper to a thickness of 0 inches, however other dimensions are envisioned. The thickness and tapering of the brake 102 prevent the brake from inadvertently catching on low obstacles that a rider is skateboarding over. The thickness of the brake 102 allows the brake to be used with both roller skate type wheels and smaller skateboard. wheels. Further the thickness and tapering prevent the brake from interfering with the performance of tricks by the rider of the skateboard.

Figure 5:
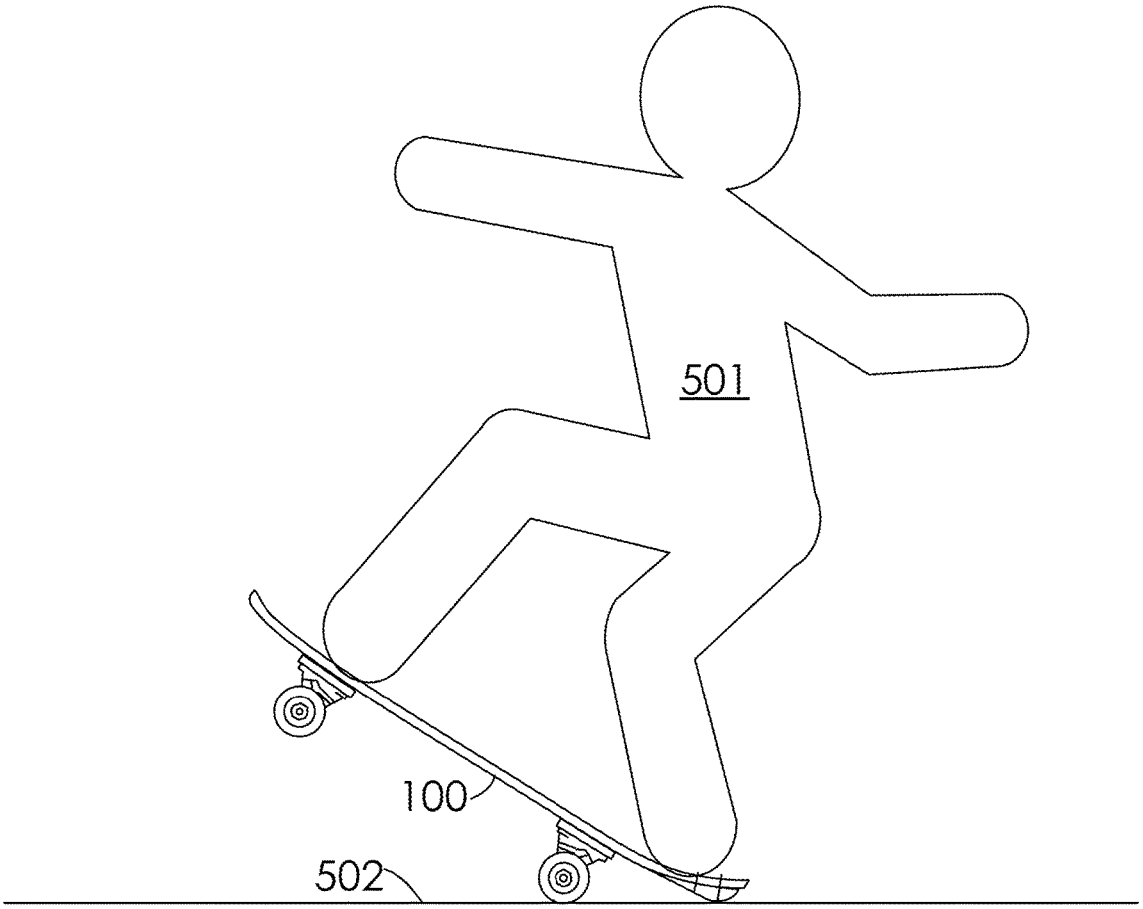
FIG. 5 shows a rider using the brake to stop.

To use the brake 102 of the skateboard 100, a rider 501 of the skateboard 100 transfers their weight to the rear tail portion 104 of the skateboard in order for the front truck wheel assembly 110 to rise off the riding surface 502 and the brake 102 to contact the riding surface 502 as shown in FIG. 5. A shown, the brake 102 does not interact nor interfere with the wheels during stopping of the skateboard 100. The rider of the skateboard may vary the force applied to the rear tail portion of the skateboard in order to control the pressure of the brake 102 against the riding surface, for example pavement. Applying more pressure will result in faster slowing or stopping of the rider and skateboard.

In addition to having superior safety and stopping power, the position of the skateboard 100 after using the brake 102 to stop allows for the upper part of the skateboard to easily be picked up as the upper portion is brought a close to pick up height when the brake is contacting the riding surface, as shown in FIG. 5.

In embodiments, the brake 102 may be made out rubber, for example a soft rubber produced by grinding up old tires and recycling the ground up old tires.

It should be understood from the foregoing that, while particular implementations have been illustrated and described, various modifications can be made thereto and are contemplated herein. It is also not intended that the disclosure be limited by the specific examples provided within the specification. Furthermore, it shall be understood that all aspects of the disclosure are not limited to the specific depictions, configurations, or relative proportions set forth herein which depend upon a variety of conditions and variables. Various modifications in form and detail of the embodiments of the disclosure will be apparent to a person skilled in the art. It is therefore contemplated that the disclosure shall also cover any such modifications, variations, and equivalents.

The invention claimed is:

1. A skateboard, comprising:

a deck;

a front truck wheel assembly coupled to the deck;

a rear truck wheel assembly coupled to the deck; and a brake coupled to the deck;

wherein the deck comprises a middle portion between the front truck wheel assembly and the rear truck wheel assembly, wherein the deck comprises a rear tail portion and the rear truck wheel assembly is coupled to the deck between the middle portion and the rear tail portion, wherein the brake is coupled to the rear tail portion;

wherein the brake is pear shaped in plan view so that a rear portion of the brake proximate to an end of the deck is wider and thicker than a front portion of the brake proximate to the rear truck wheel assembly;

wherein the brake converges in width and thickness from the rear portion of the brake to the front portion of the brake;

wherein the brake is configured so that a rider riding the skateboard on a riding surface can stop the skateboard by applying weight to the rear tail portion to cause the front truck wheel assembly to rise away from the riding surface and the pear shaped brake to contact the riding surface to stop the skateboard; and wherein no part of wheels of the skateboard engage with the brake for stopping.

2. The skateboard of claim 1, wherein the brake is comprised of rubber or re-cycled rubber.

3. The skateboard of claim 1, wherein the brake is 4 inches long and 3 inches wide at a widest portion.

4. The skateboard of claim 3, wherein the brake is 1 inch thick at a thickest portion and tapers to 0 inches thick at the front portion proximate to the front truck wheel assembly.

* * * * *